US006966137B2

(12) United States Patent
Gussalli Beretta

(10) Patent No.: US 6,966,137 B2
(45) Date of Patent: Nov. 22, 2005

(54) DEVICE FOR EXTRACTING AND EJECTING A CARTRIDGE CASE IN A FIREARM

(75) Inventor: Ugo Gussalli Beretta, Gardone val Trompia (IT)

(73) Assignee: Fabbrica D'Armi Pietro Beretta S.p.A., Brescia (IT)

( * ) Notice: Subject to any disclaimer, the term of this patent is extended or adjusted under 35 U.S.C. 154(b) by 150 days.

(21) Appl. No.: 10/428,467

(22) Filed: May 2, 2003

(65) Prior Publication Data

US 2004/0055198 A1 Mar. 25, 2004

(30) Foreign Application Priority Data

May 13, 2002 (IT) ..... MI2002A1016

(51) Int. Cl.[7] ..... F41A 15/00
(52) U.S. Cl. ..... 42/46; 42/47; 42/25; 42/16
(58) Field of Search ..... 42/46, 47, 25, 42/16, 98

(56) References Cited

U.S. PATENT DOCUMENTS 3,791,060 A 2/1974 Weaver
3,882,625 A 5/1975 Jellie
3,999,318 A 12/1976 Tellie
4,562,659 A * 1/1986 Neta ..... 42/75.03
6,523,293 B2 * 2/2003 Murello et al. ..... 42/25
6,625,917 B2 * 9/2003 Murello et al. ..... 42/16

OTHER PUBLICATIONS

EP Search Report.

* cited by examiner

*Primary Examiner*—M. Clement
(74) *Attorney, Agent, or Firm*—Hedman & Costigan, P.C.

(57) ABSTRACT

A device for extracting and ejecting a cartridge case in a firearm applied to a breechblock equipped with windows (17) on opposite sides, comprises an extraction element (19), equipped with an engagement means (28) suitable for holding a cartridge case (15), and an ejector element (20), equipped with a thrusting plane (33) suitable for taking away the cartridge case (15) from the firearm through one of such windows (17), as well as comprising a removable retainer element (27) for the extraction and ejector elements (19, 20), the extraction and ejector elements (19, 20) being housed equally effectively in seats (18).

11 Claims, 5 Drawing Sheets

DEVICE FOR EXTRACTING AND EJECTING A CARTRIDGE CASE IN A FIREARM

The present invention refers to a device for extracting and ejecting a cartridge case in a firearm.

At the end of the firing, the extraction and ejector device takes away the cartridge case through a hole or window realized in the breechblock and possibly in the casing of the firearm.

It is necessary that the cartridge case follow a trajectory which is not dangerous for the user of the firearm.

It is known to design so-called reversible firearms, in other words which can be arranged to allow ejection alternately on both sides for use by right and left-handed firers.

The main drawback of such firearms consists of the complexity and the high number of components which make up the extraction and ejector mechanism and which must be disassembled and reassembled to convert the firearm.

This brings a greater manufacturing cost, less reliability as well as longer and more complicated operations to convert the firearm.

Hereafter specific reference shall be made to a semiautomatic rifle, although that which is the object of the invention can be applied to other types of firearms.

Moreover, given that the invention is intended for experts in the field of firearms, we leave out the detailed description of the structure and operation of a firearm, in particular of a rifle like the one described. We just give a reminder of the functions of the firearm parts involved in the technical problem forming the basis of the invention.

The purpose of the present invention is that of providing an extraction and ejection device for a firearm which can be converted between right and left-handed and which has a small number of components which are easy to assemble.

Another purpose of the present invention is that of realizing a device which can be adapted to different types of firearms.

Another purpose of the present invention is that of realizing a device for extracting and ejecting a cartridge case in a firearm which is particularly simple and functional, with low costs.

These purposes according to the present invention are accomplished by providing an extraction and ejector device as outline in claim 1.

Further characteristics are foreseen in the dependent claims.

The characteristics and advantages of an extraction and ejector device according to the present invention shall become clearer from the following description, given as an example and not for limiting purposes, referring to the attached schematic drawings, in which.

With reference to the figures a device for extracting and ejecting a cartridge case in a firearm is shown, as a non-limiting example, wholly indicated with 10.

The device is applied to a breechblock-carrier 12, or breechblock, suitable for receiving a firing pin, not shown, inside of it, and equipped at the top with a seat 13 for a spring which controls the movement of the breechblock, also not shown.

Figure 1:
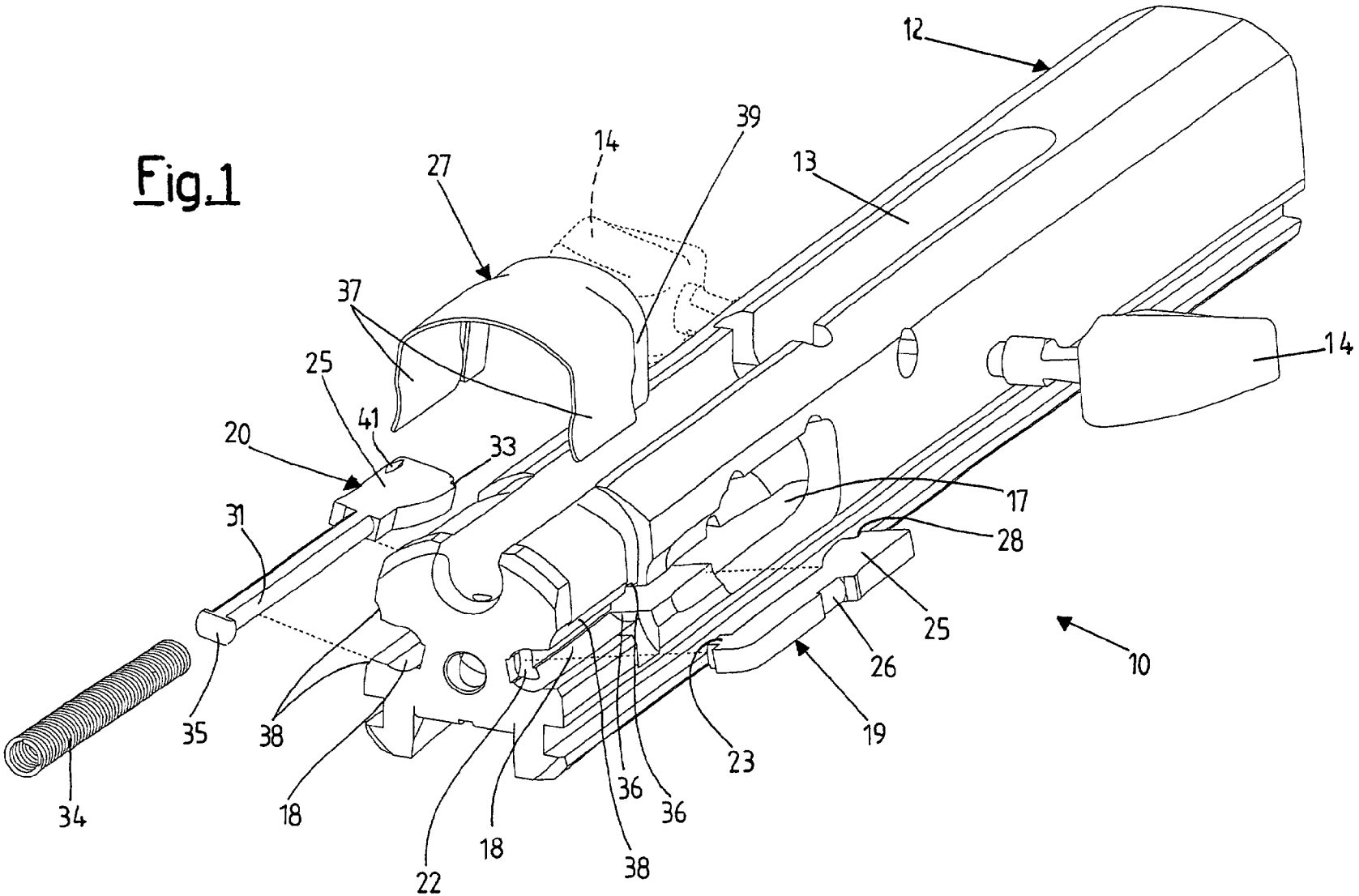
FIG. 1 is an exploded view of a device for extracting and ejecting a cartridge case in a firearm, object of the present invention, assembled to realise right-hand side ejection of the cartridge case.

A choking handle 14 is also applied to the breechblock 12, which can be mounted equally on the right or left-hand side in a firearm whether the side of ejection be right or left, according to that which is represented with a continuous and broken line in FIG. 1.

The breechblock 12, which in the example shown has symmetrical construction with respect to a middle plane of symmetry 16, is equipped on the side with windows 17, through one of which a cartridge case 15 is ejected after firing.

Downstream of the windows 17, the breechblock 12 is equipped with seats 18, which can be the same as each other, to receive either an extractor element 19 or an ejector element 20.

Since the firearm is reversible the ejection of the cartridge case can take place both from the right window 17 and from the left window 17, according to how the extraction and ejector elements 19 and 20 are positioned.

Figure 3:
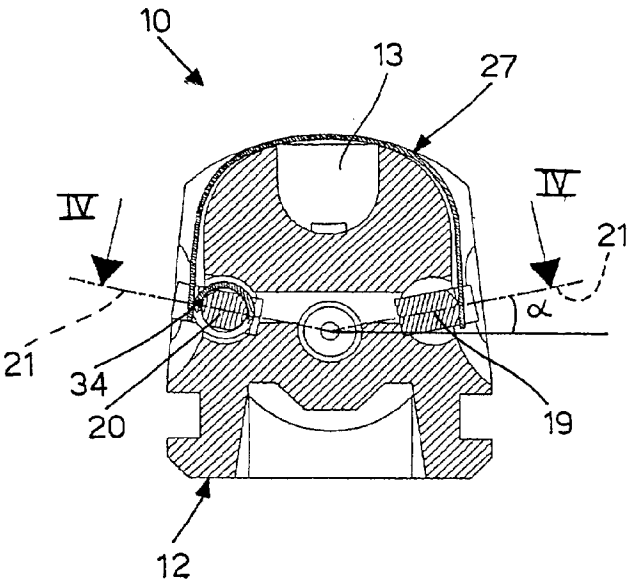
FIG. 3 is a cross section realised according to line III—III of FIG. 2.

The seats 18, in which the extraction and ejector elements 19 and 20 are inserted and kept in position, are arranged according to planes 21, for example tilted by an angle $\alpha$ with respect to a horizontal sliding plane of said breechblock-carrier 12 according to that which is indicated in FIG. 3.

For the sake of simplicity and clarity of representation, the sections of FIGS. 4 to 7 are realized along the tilted planes 21.

The seats 18, with a shape substantially matching the extraction and ejector elements 19 and 20, have in particular a centering groove 22 for integral positioning with the translation of the extraction element 19 with respect to the breechblock 12, which is equipped at one end with a suitable matching centering ridge 23.

In a front portion, the seats 18 also have a base wall 24 for example shaped according to a curved profile to receive intervention terminals 25 of the extraction element 19 and of the ejector element 20 with a substantially matching shape.

The extraction element 19, or extractor, is an element with a complex shape and a substantially rectangular section, which, as well as the ridge 23 for integral positioning with the translation with respect to the breechblock 12 and the intervention terminal 25 with a curved profile, is equipped with a grooved seat 26, in which a retainer element 27 intervenes, which holds the extractor 19 in the seat 18.

Figure 4:
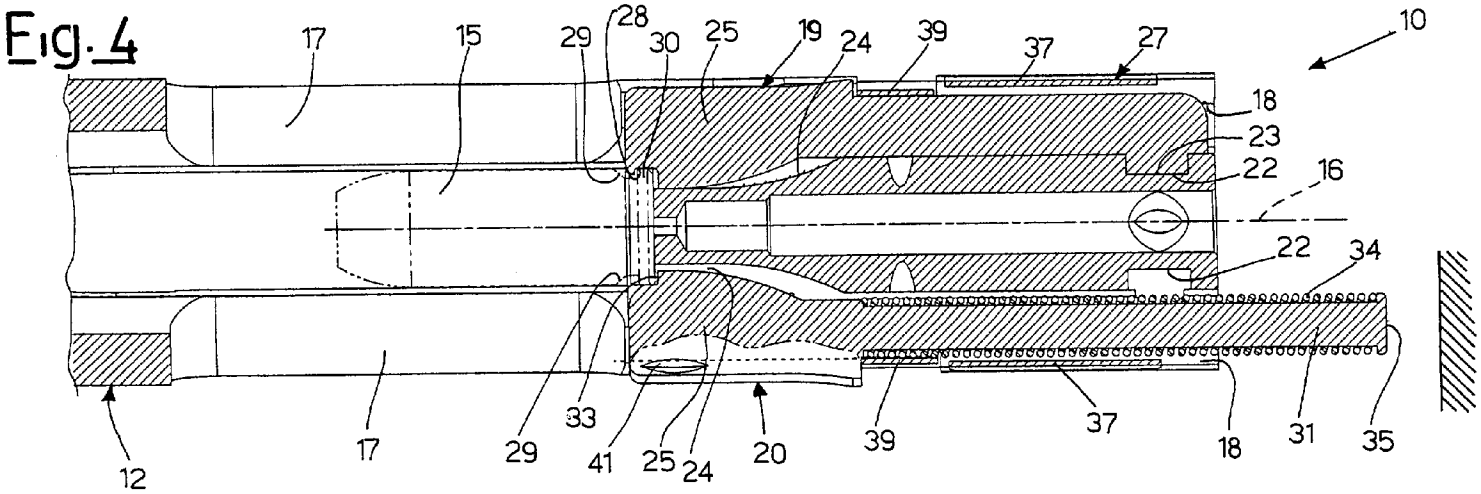
FIG. 4 is a section realised according to two tilted planes shown with IV—IV of FIG. 3 of the extraction and ejector device, object of the present invention, wherein the cartridge case is held in the breechblock.
Figure 5:
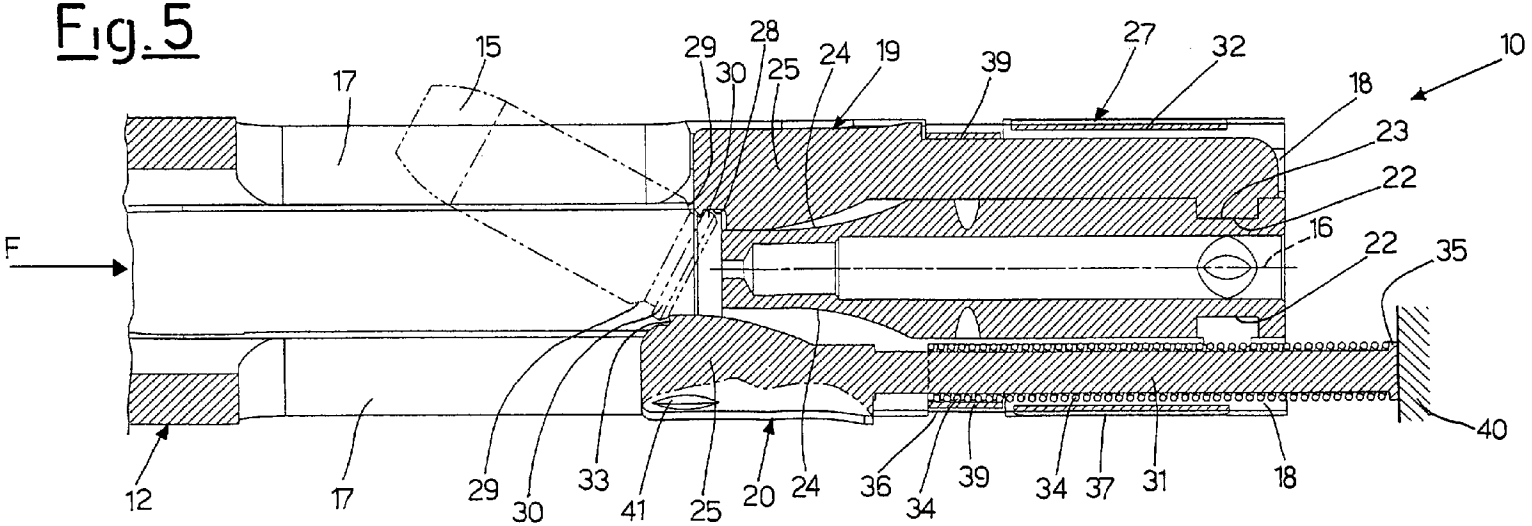
FIG. 5 shows the device of FIG. 4 during the extraction-ejection of the cartridge case.

The intervention terminal 25 of the extractor 19 is also equipped with an engagement means 28, such as an extractor tooth, which fits into an annular support groove 29 of a rim 30 of the cartridge case 15, holding it (FIGS. 4 and 5).

The extraction element 19, whose relative translation with respect to the breechblock 12 is prevented, can rotate in the plane 21, in other words about an axis perpendicular to the plan of the extractor itself, so as to separate the intervention terminal 25 from the base wall 24 of the seat 18, to allow the hooking of the cartridge case 15 during the loading of the barrel, not shown.

The ejector element 20, or ejector, is an element which protrudes from the back of breechblock 12 with a complex shape comprising a first elongated portion 31 with a substantially cylindrical shape, and having an intervention terminal 25, the curved profile of which has a shape equivalent to the engagement terminal of the extractor 19. The intervention terminal 25 of the ejector 20 is equipped with a housing, which receives the rim 30 of the cartridge case 15, equipped with a thrusting plane 33, for taking away the cartridge case 15 through the window 17 opposite the ejector 20.

The ejector element 20 is kept in position in the seat 18 by the same retainer element 27 which holds the extractor 19.

The ejector element 20 is also equipped with a recognition notch 41, or "loading barrel warning", realised on the intervention terminal 25, in a position visible from the outside with the firearm assembled in the presence of a cartridge case in the chamber.

Figure 6:
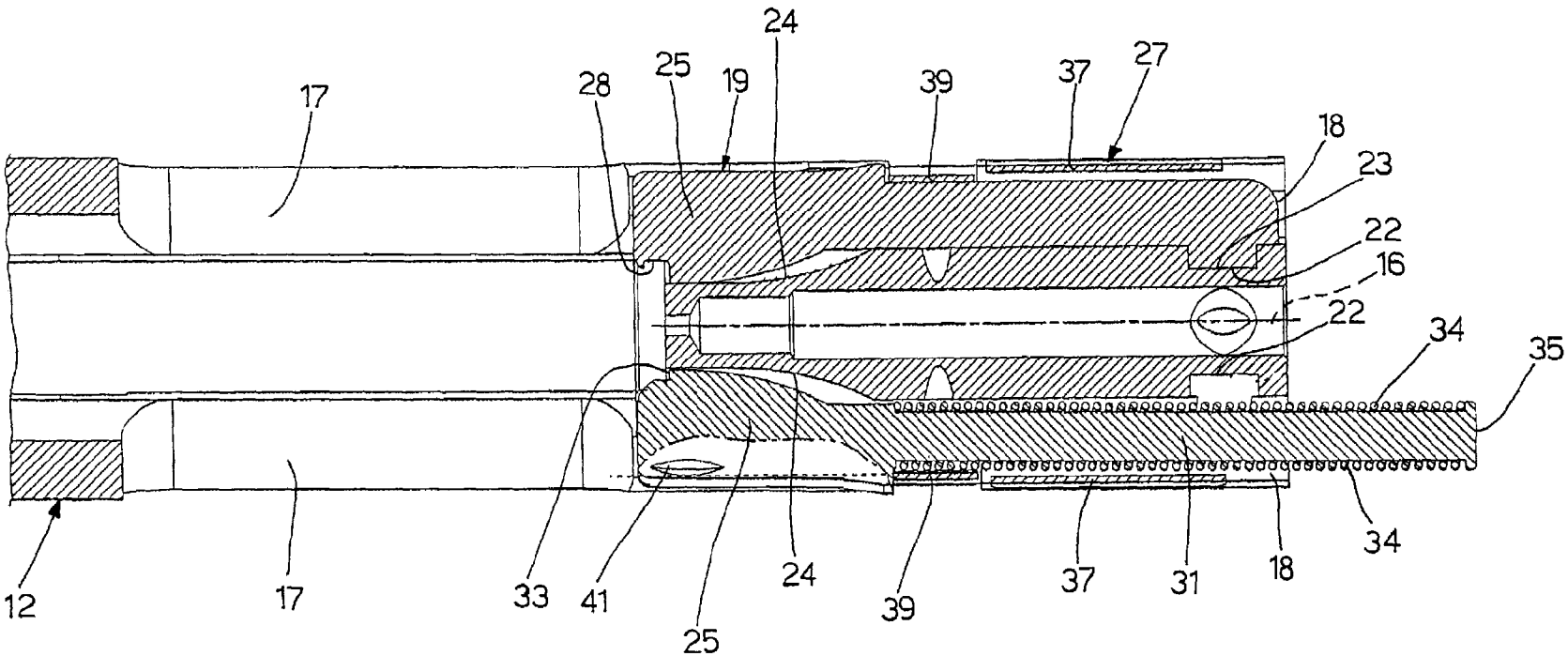
FIG. 6 shows the device of FIG. 4 in rest position, in other words with the barrel not loaded.

Indeed, in the rest position shown in FIG. 6, in other words with the barrel not loaded, the ejector 20 is kept by the springed retainer element 27 stuck to the wall 24 of the seat 18. When, on the other hand, the cartridge case 15 is in the chamber (FIG. 4), the rim of the cartridge case 30 keeps the ejector detached from the wall 24 of the seat 18, and thus protruding from the breechblock 12, showing the recognition notch 41.

Moreover, the recognition notch 41 signals to the user that the ejection of the cartridge case shall take place on the opposite side with respect to such a notch 41.

According to a preferred embodiment, shown in the figures, the retainer element 27 is an elastic element pressure mounted on the breechblock.

Figure 2:
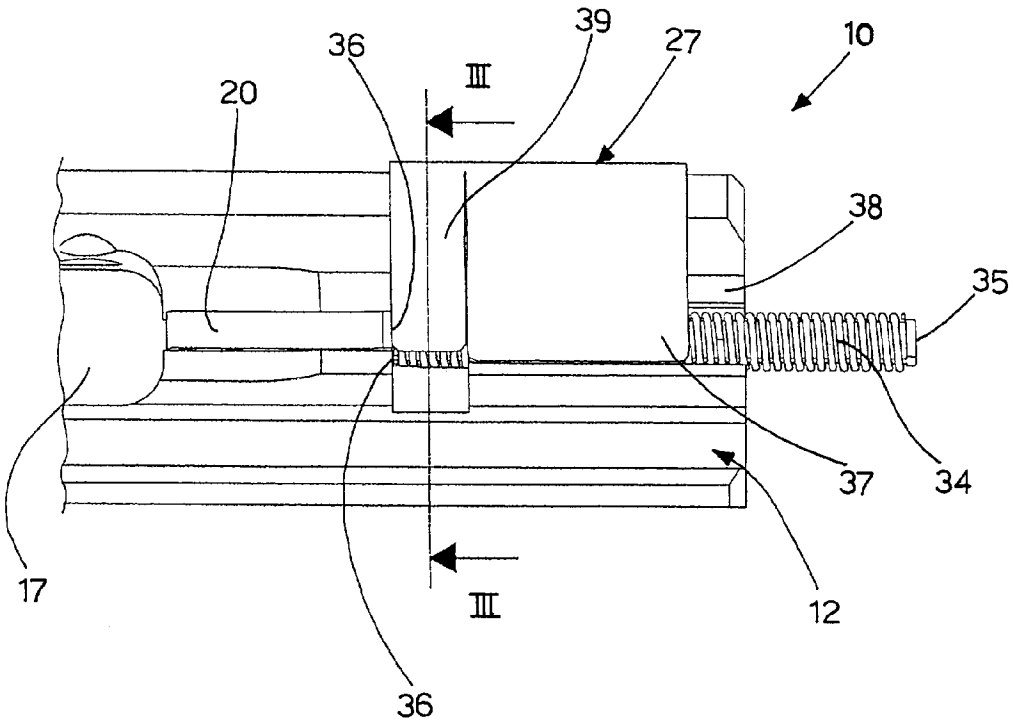
FIG. 2 shows a detail of the device of FIG. 1.

The retainer element 27 consists of an elastic saddle-shaped plate slotted onto the breechblock 12, 50 that hooking portions 37 engage in concave seats 38 formed in the side walls of the breechblock 12 (FIGS. 1 and 2) and so that two presser tabs 39 are engaged in the grooved seat 26 of the extractor 19 and against the helical spring 34 of the ejector 20.

The tabs 39, which hold the extractor 19 and the ejector 20, yield elastically to allow them to rotate in the planes 21 and to allow the consequent separating of the intervention terminals 25 from the walls 24.

The ejection of the cartridge case 15 at the end of the firing steps, takes place after the sliding back of the breechblock 12 in the direction of the arrow F of FIG. 5, which initially drags with it both the extractor 19 and the ejector 20, as well as the cartridge case 15 held by the extractor tooth 28.

When the portion 31 of the ejector 20, protruding from the rear of the breechblock 12, comes into abutment against a stop surface 40, for example of the body of the firearm, the subsequent sliding back of the breechblock 12 causes the translational advance of the ejector 20 with respect to the breechblock itself and the consequent compression of the helical spring 34 between the rear stop element 35 and the abutment planes 36 of the breechblock 12.

The extractor 19, which remains integral with the breechblock 12 with respect to the translation, holds the rim 30 of the cartridge case 15 locally.

Thrusted by the thrusting plane 33 of the ejector element 20, and thus subjected to a mechanical torque, the cartridge case 15 rotates and is taken away through the window 17 opposite the ejector 20.

Finally, when the breechblock-carrier 12 retakes its initial advanced position, the helical spring 34, biased during the ejection of the cartridge case, takes the ejector element 20 back into the rest position of FIG. 6.

Figure 7:
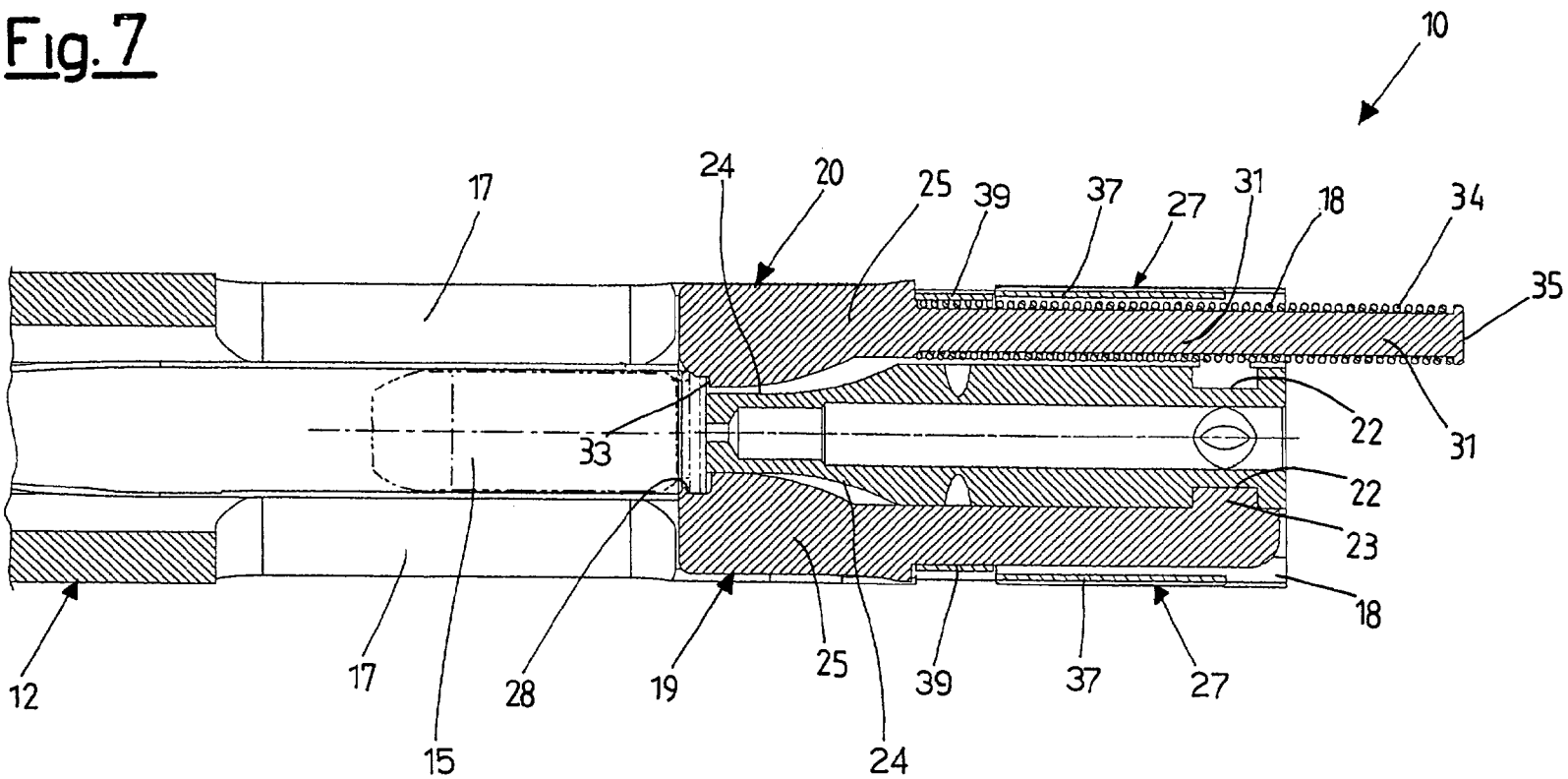
FIG. 7 shows the device for extracting and ejecting a cartridge case in a firearm, assembled to realize left-hand side ejection of the cartridge case represented according to a section analogous to that of FIG. 4.

To change the direction of extraction and ejection of the cartridge case and to pass, for example, from a right-handed firearm of FIGS. 1–6 to a left-handed firearm of FIG. 7 it is sufficient to remove the plate spring 27, switch the extractor 19 and the ejector 20 and pressure reposition the elastic element 27 in the concave seat 38.

The device for extracting and ejecting a cartridge case in a firearm has the advantage of being made up of a small number of components which can easily be assembled on opposite sides of the firearm to make the firearm reversible.

The seats realized in the breechblock are advantageously suitable for housing both the extraction element and the ejector element, just as the retainer element acts equally effectively on both of the elements.

The device for extracting and ejecting a cartridge case in a firearm thus conceived is susceptible to numerous modifications and variants, all of which are covered by the invention. Moreover, all of the details can be replaced with technically equivalent elements. In practice the materials used, as well as the sizes, can be whatever according to the technical requirements.

What is claimed is:

1. Device for extracting and ejecting a cartridge case in a firearm applied to a breechblock equipped with windows (17) on opposite sides, which comprises an extraction element (19), equipped with an engagement means (28) suitable for holding a cartridge case (15), and an ejector element (20), equipped with a thrusting plane (33) suitable for taking away said cartridge case (15) from the firearm through one of said windows (17), and further comprising a removable retainer element (27) for said extraction and ejector elements (19, 20) wherein said removable retainer element (27) is an elastic plate, and said extraction and ejector elements (19, 20) being optionally housed on either side of breechblock-carrier (12) in seats (18).

2. Device according to claim 1, wherein said seats (18) are functionally the same.

3. Device according to claim 1, wherein said seats (18) are arranged along tilted planes (21) tilted by an angle ($\alpha$) with respect to a horizontal sliding plane of said breechblock-carrier.

4. Device according to claim 3, wherein said extraction element (19) is housed integrally with respect to said breechblock (12) and rotatable in said tilted planes (21).

5. Device according to claim 3, wherein said ejector element (20) is translatable with respect to said breechblock (12) and rotatable in said tilted planes (21).

6. Device according to claim 1, wherein said seats (18) are equipped with a centering groove (22) for the positioning of a ridge (23) of said extraction element (19).

7. Device according to claim 1, wherein said engagement means suitable for holding said cartridge case (15) is an extraction tooth (28) suitable for engaging in an annular support groove (29) of said cartridge case (15).

8. Device according to claim 1, wherein said ejector element (20) is equipped with a substantially cylindrical portion (31), protruding from the rear of said breechblock (12) and upon which a spring (34) is mounted.

9. Device according to claim 8, wherein said spring (34) is positioned in abutment between a rear stop element (35) of said ejector (20) and abutment planes (36) formed in said breechblock (12) near to said seats (18).

10. Device for extracting and ejecting a cartridge case in a firearm applied to a breechblock equipped with windows (17) on opposite sides, which comprises an extraction element (19), equipped with an engagement means (28) suitable for holding a cartridge case (15), and an ejector element (20), equipped with a thrusting plane (33) suitable for taking away said cartridge case (15) from the firearm through one of said windows (17), and further comprising a removable retainer element (27) for said extraction and ejector elements (19, 20) said extraction and ejector elements (19, 20) being housed on opposite sides of a breechblock-carrier (12) in seats (18) wherein said retainer element is an elastic plate (27) equipped with hooking portions (37), suitable for pressure engaging in concave seats (38) of side walls of said breechblock (12), and with pressure tabs (39) engaged on said extraction and ejector element (19, 20).

11. Device according to claim 10, wherein said extraction element (19) is equipped with a grooved seat (26) for the intervention of one of said tabs (39).

* * * * *